United States Patent [19]

King

[11] Patent Number: 4,695,186

[45] Date of Patent: Sep. 22, 1987

[54] ASPHALT HANDLING APPARATUS

[76] Inventor: Timothy W. King, Box 1234, Billings, Mont. 59103

[21] Appl. No.: 912,385

[22] Filed: Sep. 26, 1986

[51] Int. Cl.[4] ..... E01C 19/12

[52] U.S. Cl. ..... 404/111; 404/101; 404/110; 404/128; 366/23; 126/343.5 A

[58] Field of Search ..... 404/101, 108, 110, 111, 404/113, 117, 128; 126/343.5 A; 222/146.2, 626; 366/22-25

[56] References Cited

U.S. PATENT DOCUMENTS

| | | | |
|---|---|---|---|
| 1,546,185 | 7/1925 | Andresen | 404/111 X |
| 4,196,827 | 4/1980 | Leafdale | 404/111 X |

OTHER PUBLICATIONS

Cimline, "Trailer-Mounted Joint Seal Melter-Applicator", Sep. 1983.

H. D. Industries, Inc., "Pro Patch Pot Hole Patcher", Jun. 1986.

Northwest Manufacturing and Distribution (NMD) Inc., "The Thermo-Lay Patching System", 1982.

RGS Industries, Inc., "The Thermo-Lay Patching System", 1981.

Rosco Manufacturing Company, "Rosco Sealers", Jan. 1983.

*Primary Examiner*—Stephen J. Novosad
*Assistant Examiner*—John F. Letchford
*Attorney, Agent, or Firm*—Arthur L. Urban

[57] ABSTRACT

Asphalt handling apparatus includes a carriage portion, a hopper portion, a hopper heating portion, an asphalt dispensing portion, a liquid tack material dispensing portion and an equipment lifting portion. The hopper portion includes an elongated trough section with a generally V-shaped cross section. A pair of bi-fold doors selectively cover an open top section. The hopper heating portion includes an enclosed heat transfer medium first chamber disposed immediately below the V-shaped trough section and in direct contact therewith. The first chamber includes sloping wing sections and a deeper central section communicating therewith. A U-shaped burner channel is disposed substantially horizontally within the central section with a gas burner along a first arm and an exhaust stack extends upwardly from a second arm. An elongated electrical heating element is disposed between the arms. The liquid tack material dispensing portion includes an elongated second chamber located alongside the central section of the hopper heating portion. The second chamber includes tubing therein communicating with the central section of the hopper heating portion. Valve mechanism communicates with an outlet of the second chamber. A cleaning fluid reservoir communicates with the valve mechanism. The equipment lifting portion includes a frame assembly including a fixed section and a vertically movable section slidably engageable therewith, the movable section including an equipment engaging member.

19 Claims, 6 Drawing Figures

ASPHALT HANDLING APPARATUS

This invention relates to a novel asphalt handling apparatus and more particularly relates to a new asphalt handling apparatus for use in patching chuckholes.

As civilization has developed, people have become more and more dependent on their vehicles, originally wagons and later cars and trucks. Not only has the number of vehicles increased dramatically through the years, but also they are being operated year around rather than only in good weather.

Heavy vehicular traffic on unpaved roads in inclement weather can quickly reduce a dirt or gravel road surface to a quagmire rendering it impassable. Thus, the paving of roads has become a necessity until today in urban areas almost all roads are paved.

Although paved roads provide a smooth surface when new, continuing use and weather exposure combined with heavy vehicle loads eventually cause areas of the pavement to break up and form chuckholes, cracks and similar defects. To restore a smooth road surface, it is necessary to repair the pavement.

Years ago, repairs generally were done by laborers using hand tools and more recently, with power hammers, rollers, tampers, etc. Loose material around the edge of a hole was removed, a tack liquid applied to the cleaned surface, the hole filled with hot asphalt and tamped into place. With these operations, ordinarily it required a number of men and vehicles to accomplish the various steps and carry the materials and equipment.

More recently, a portable machine was developed that enabled the steps to be done from a single vehicle. U.S. Pat. No. 4,196,827 describes such a machine. The machine utilizes an asphalt hopper with a reservoir containing liquid asphalt tack material positioned below and contiguous with the hopper. A heat source located in the reservoir heats the tack material and thereby the asphalt in the hopper. A screw conveyor is located in the hopper to discharge the asphalt. Power tools such as hammers, tampers, rollers and the like are operated from the hydraulic fluid system of the machine.

Although this machine has gained popularity, recent changes in government regulations pertaining to the use of asphalt and liquid asphalt tack materials created new problems. These regulations forced the abandonment of the conventional asphalt and tack materials because of the directive to reduce the possibility of pollution of the surrounding area. Tack solvents having low volatilization temperatures could no longer be used in the tack liquids and had to be replaced with non-polluting materials such as aqueous emulsions. Similarly, volatile solvents of the asphalt mix had to be replaced with materials which were less volatile.

These substitutions necessitated that the asphalt mix be maintained at higher temperatures than formerly. Such temperatures could not be attained using aqueous emulsion tack materials as the heating medium.

To achieve these higher temperature, new heat transfer materials had to be found for heating the asphalt mix. Simply replacing the former tack material in the tank under the asphalt hopper in the machine of the patent and placing the new tack material in a separate container does not provide a workable system.

Since the asphalt mix is now maintained at a higher temperature, the time for heating the mix has been significantly lengthened. Also, means for heating the tack material had to be found so it can be applied hot. A further limiting factor is that these additional objectives should be accomplished in the same space that formerly was occupied by the system of the patent.

Although it has been attempted to achieve these objectives by the use of extra heaters and insulating materials, these proposals do not provide desirable solutions to the problems created by the required reformulation of the asphalt mix and the tack material. Thus, there is a need for new procedures and equipment that overcome the deficiencies of previous methods and machines.

The present invention provides a novel asphalt handling apparatus which not only overcomes the shortcomings of earlier procedures, but also provides additional features and advantages not found in such earlier expedients. The asphalt handling apparatus of the invention provides controlled heating of both the asphalt mix and the tack material on a continuing basis. Such controlled heating is achieved simply and efficiently with a high degree of safety.

The asphalt handling apparatus of the present invention is simple in design and can be produced to be sold at competitive pricing. Commercially available materials and components can be employed in is manufacture. Conventional fabricating methods and techniques and semi-skilled labor can be utilized in the production of the asphalt handling apparatus.

The asphalt handling apparatus of the invention enables an individual, or at most two persons, to patch asphalt surfaces without assistance from others. The apparatus provides all of the materials and equipment on a single vehicle necessary to make the patches. The apparatus can be used efficiently by a workman experienced in asphalt patching of roads after a minimum of instruction.

The asphalt handling apparatus is durable in construction and has a long useful life. A minimum of maintenance is required to keep the apparatus in good working condition. The apparatus can be modified and/or accessories added for specific patching conditions.

These and other benefits and advantages of the novel asphalt handling apparatus of the present invention will be apparent from the following description and the accompanying drawings in which.

Figure 1:
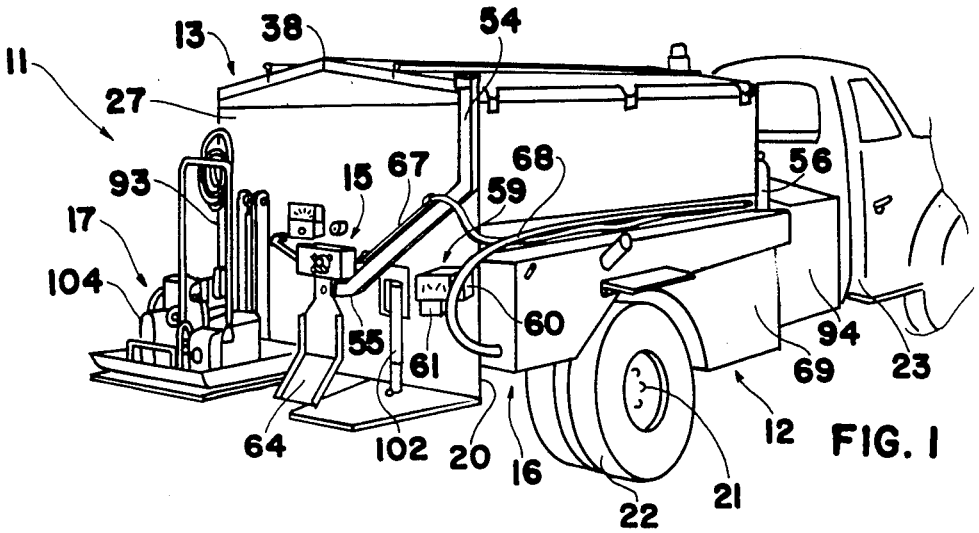
FIG. 1 is a view in perspective of one form of asphalt handling apparatus of the invention mounted on a truck chassis.

As shown in the drawings, one form of the novel asphalt handling apparatus 11 of the present invention includes a carriage portion 12, a hopper portion 13, a hopper heating portion 14, an asphalt dispensing portion 15, a liquid tack material dispensing portion 16 and an equipment lifting portion 17.

The carriage portion 12 of the asphalt handling apparatus 11 of the invention includes a frame section 20. An axle member 21 extends transversely of the frame section. A wheel 22 is rotatably carried at each end of the axle member 21. Advantageously, the carriage portion 12 is included in a truck 23 or a trailer (not shown).

The hopper portion 13 of the asphalt handling apparatus 11 includes an elongated trough section 25. The trough section 25 has a generally V-shaped cross section. The trough section includes transverse end sections 26 and 27 with peaked upper edges 28. The trough section includes a generally rectangular open top section 29.

A pair of bi-fold doors 31 and 32 selectively cover the open top section 29. One edge 33 or 34 of each bi-fold door is pivotally connected to a longitudinal edge 35 or 36 respectively of the trough section 25 adjacent the open top section 29.

The bi-fold doors when closed in a flat configuration as shown in FIG. 1, contact one another along a horizontal centerline 38 of the trough section 25. The centerline 38 is located a significant distance above the longitudinal edges 35 and 36 of the trough section. This alignment of the doors provides a peaked roofline which not only provides a greater capacity, but also rapidly sheds rain and snow from the apparatus.

Corners of the free edges 39 and 40 of the bi-fold doors move from an open to a closed position closely adjacent to upper edges 28 of the trough transverse end sections 26 and 27. This close spacing is maintained through brackets 42 and 43 that extend downwardly from the free corners and slidably engage the adjacent upper edges of the trough transverse end sections.

Figure 2:
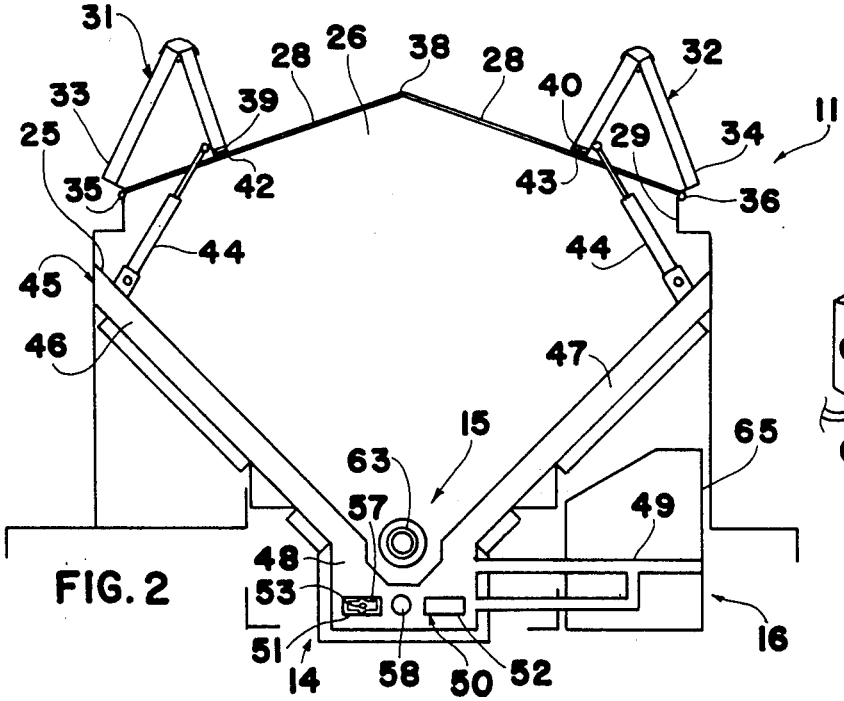
FIG. 2 is an enlarged cross sectional view of the asphalt handling apparatus shown in FIG. 1 with the hopper open.
Figure 3:
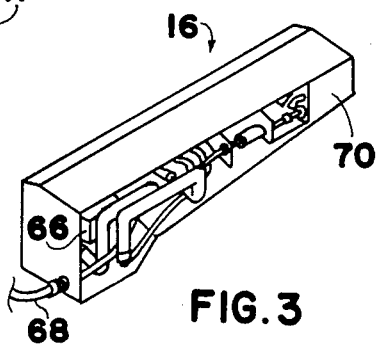
FIG. 3 is a view in perspective of the tack material dispensing portion of the asphalt handling apparatus shown in FIGS. 1 and 2.

Advantageously, the bi-fold doors 31 and 32 are insulated. The bi-fold doors preferably are activated by piston/cylinder combinations 44 that are located within the trough section as shown in FIG. 2.

Hopper heating portion 14 of the asphalt handling apparatus 11 of the invention includes an enclosed first chamber 45. The chamber 45 is disposed immediately below the V-shaped trough section 25 and in direct contact therewith. The chamber 45 includes sloping wing sections 46 and 47 that have relatively thin cross sections. The first chamber also includes a deeper central section 48 that communicates with the wing sections and extends along the lowest point of the trough section. A heat transfer medium is disposed within the chamber.

The hopper heating portion 14 further includes a U-shaped burner channel 50 with arm sections 51 and 52. The channel 50 is disposed within the central section 48 of the chamber 45 along the length thereof in a substantially horizontal orientation.

A gas burner 53 is disposed along the length of a first arm 51 of the channel, preferably within a heat distributing sleeve 57. An exhaust stack 54 extends upwardly from a free end 55 of a second arm 52 of the channel 50. A gas reservoir 56 shown as a tank supplies fuel for the burner 53.

An elongated electrical heating element 58 is disposed within the central section 48 of the hopper heating portion. The electrical heating element 58 is disposed between the arms 51 and 52 of the U-shaped burner channel 50. Advantageously, the electrical element is oriented substantially parallel to the channel arms.

Control panel 59 at the rear of the hopper portion operates the burner 53 and the heating element 58 as well as the auger doors and accessory hydraulic system if desired. The heating controls preferably include programming means 60 for valve means 61. In this way, the temperature can be controlled within desired limits. Also, the valve can provide a small gas flow to the burner 53 initially to facilitate safe automatic ignition thereof and after a time interval provide a greater operating gas flow.

The asphalt dispensing portion 15 of the handling apparatus 11 includes a screw conveyor 63. The screw conveyor 63 is located within the trough section 25 along the lowest point thereof. Drive means such as a hydraulic motor (not shown) rotate the conveyor. A pivotable delivery chute 64 advantageously is disposed at the outlet of the conveyor.

The liquid tack material dispensing portion 16 of the asphalt handling apparatus 11 of the invention includes an elongated second chamber 65. The second chamber 65 is located outside the hopper portion 13 alongside the central section 48 of the hopper heating portion 14 and under one sloping wing section thereof, shown in FIG. 2 as wing 47. The second chamber includes tubing 49 therein communicating with the central section 48 of the hopper heating portion.

Valve means 66 is connected to an outlet of the second chamber 63. Delivery means 72 includes a wand 67 with a nozzle and a length of hose 68 that are connected to the valve means 66. A cleaning fluid reservoir 69 is located adjacent to the second chamber and is connected to the valve 66. Flow of the tack material and the cleaning fluid is achieved through a pump 70 associated with the valve.

Figure 4:
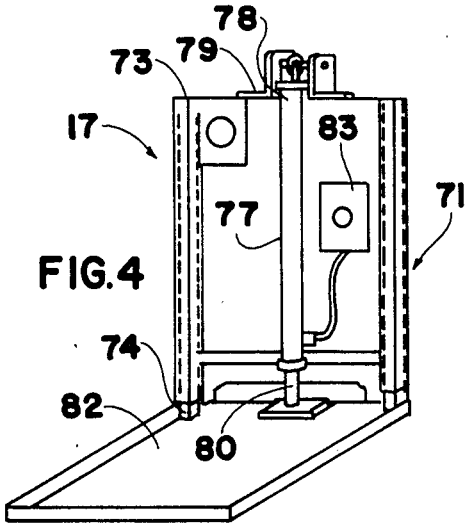
FIG. 4 is a view in perspective of one form of the equipment lifting portion of the asphalt handling apparatus shown in FIG. 1.
Figure 5:
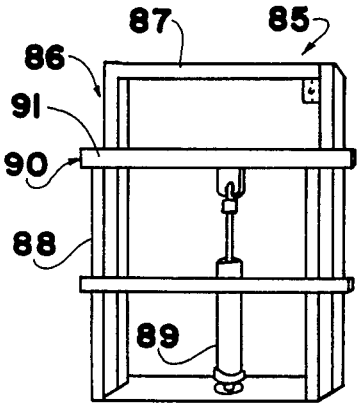
FIG. 5 is a view in perspective of another form of the equipment lifting portion of the asphalt handling apparatus of the invention.

The equipment lifting portion 17 of the apparatus 11 may take a number of forms as shown in FIGS. 4 and 5. The equipment lifting portion 17 of FIG. 4 includes a frame assembly 71. The frame assembly is disposed in a generally vertical plane and is affixed adjacent to a rear transverse trough section 27. The frame assembly is located on the side of delivery chute 64 of the conveyor that is remote from the liquid tack material dispensing portion 16.

The frame assembly 71 includes a fixed section 73 and a vertically movable section 74 slidably engageable therewith. The movable section 74 includes an equipment engaging member 75. Movement of the equipment engaging member is effected through a vertical oriented piston/cylinder combination 77. The piston/cylinder combination has one end 78 secured to an end 79 of the fixed section 73 of the frame assembly and extends therealong. An opposite end 80 of the piston/cylinder combination 77 is secured to the movable section 74 of the frame assembly.

As shown in FIG. 4, the equipment engaging member 75 advantageously includes a platform 82 at the bottom of the movable section 74. The piston/cylinder combination 77 extends downwardly to the platform. The platform 82 preferably includes actuating means 83 that automatically raises it after an interval to prevent moving the apparatus with the platform on the ground.

FIG. 5 illustrates another form of equipment lifting portion 85 including a frame assembly 86 with a fixed section 87, a movable section 88 and a piston/cylinder combination 89. An equipment engaging member 90 includes a horizontal bar member 91 at the top of the movable section 88. The piston/cylinder combination 89 extends upwardly fom the base of the fixed section 87 to the bar member.

The asphalt handling apparatus 11 of the invention also may include one or more accessories. For example, the apparatus as shown in FIG. 1 includes a hand propane torch 93 and a storage bin 94. The torch 93 facilitates drying of the areas to be patched. The bin 94 provides a conveniently located container for depositing material removed from the holes. This material can be dumped later or in some cases can be recycled back to the hopper.

Figure 6:
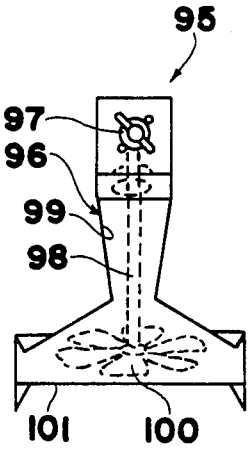
FIG. 6 is a schematic illustration of one form of a sanding unit for use with the asphalt handling apparatus of the invention.

FIG. 6 illustrates a sanding unit 95 suitable for use with the apparatus 11. The sanding unit includes a housing 96 with a drive motor 97 located in an upper compartment thereof. A drive shaft 98 extends downwardly along a chute 99 and has a distributor 100 disposed on the lower end thereof adjacent the outlet 101 of the chute. Advantageously the motor 97 is independently controlled hydraulically from the driver's position.

In the use of the asphalt handling apparatus 11 of the present invention, truck 23 first has hopper 13 filled with asphalt mix, the first chamber 45 filled with heat transfer oil and the second chamber 65 filled with liquid tack material. The burner 53 and/or the electrical element 58 then are actuated for a period of time sufficient to heat the transfer oil and thereby the mix and tack liquid to the desired temperature. The electrical heater 58 provides continuous heating safely overnight.

The truck then is driven to the road areas to be patched and the truck positioned so the discharge chute 64 at the rear is adjacent to the chuckhole. The hole is prepared for patching by chipping and squaring the edges with a hydraulic chipping hammer or breaker 102 that has been carried on a fixed rear platform 103. The hammer is powered through the hydraulic system of the apparatus. Excess loose material may be removed and placed in the storage bin 94.

The hole then is dried with portable torch 93 that is carried on the rear of the hopper portion 13. This insures a dry cavity prior to compacting, sealing or tacking whether the weather is cold, wet or freezing.

The base of the cavity is compacted with the hydraulic hammer or more preferably with a vibratory plate 104 carried on the lifting portion 17. Some loose material can be re-used as filler material and compacted in the hole.

The bottom and sides of the cavity are sprayed with the tack liquid using wand 67 on the end of hose 68. After completing the spraying, valve 66 is reversed to purge the wand the hose and then positioned for flushing with a cleaning fluid. The cavity is now ready for filling.

The hot asphalt mix in trough section 25 is dispensed by hydraulic powered screw conveyor 63. Moving a lever at control panel 59 dispenses a desired quantity of the mix onto pivoting chute 64 which guides it into the pothole cavity. The asphalt is raked, leveled and then compacted with the hydraulic hammer 102 or vibratory plate 104. The repair is now complete and ready for traffic.

The truck 23 then is moved to the next hole and the patching sequence repeated. Each hole is repaired by a one or two man crew simply and easily. The repairs can be made year round regardless of weather conditions. The materials are maintained at the desired elevated temperatures to provide optimum sealing and patching conditions and patch durability. All of the materials are transferred into the pothole without having to be handled by the workmen. The transfers are effected by the simple operation of the hydraulic controls.

The hammers, breakers and vibratory plate or roller are all carried on the machine and powered by the common hydraulic system. The one apparatus does the work that ordinarily required a dump truck, air compressor, hot oil tank truck, roller and the many additional workmen.

In place of the lifting platform 82 shown in FIGS. 1 and 4 for the carrying of the vibratory plate 104, the platform can be replaced with the lifting portion 85 shown in FIG. 5. The equipment engaging bar member 91 can be used to carry a small roller (not shown) from one patching site to the next in the same way that the vibratory plate 104 is carried as described above. In each case, the lifting portion advantageously includes controls to automatically raise the movable section so the truck will not be moved with the platform or roller on the ground.

Sanding unit 95 of FIG. 6 can be used by attaching it to the rear of the screw conveyor 63. This can be accomplished by removing delivery chute 64 and securing the sanding unit in its place. The hydraulic motor 97 is operatively connected to the hydraulic system of the apparatus with control of the sander being effected from the truck cab.

The sand in the hopper portion 14 can be heated if desired through heating portion 14 described above including burner 53 and electrical heating element 58. By varying the speed of the motor, the distributor 100 at the lower end of drive shaft 98 will spread a desired pattern of heated sand behind the track as it is driven along a road. This operation is performed and controlled by a truck driver from his position inside the cab. The sanding unit also can be used to fill sand bags for flood control operations.

The above description and the accompanying drawings show that the present invention provides a novel asphalt handling apparatus which overcomes the deficiencies of previous machines and methods. In addition, the asphalt handling apparatus of the invention provides features and advantages not found in earlier machines and procedures. The apparatus provides controlled continuous heating of the asphalt mix and tack material. This enables chunks of road mix to be recycled back into the apparatus. Also, this continuous heating which maintains the materials at optimum temperatures together with the other design features of the apparatus results in patches with a high degree of durability, sometimes longer than the surrounding paving itself.

With the apparatus of the invention there is no dumping onto the ground and shoveling of the mix into chuckholes in the surrounding area by a number of workmen. Good heat retention is enhanced through the use of the insulated doors which are self-cleaning so they seal tightly with the trough section. Also, the doors do not interfere with loading such as from front end loaders.

The asphalt handling apparatus of the present invention is simple in design and competitively priced. Commercially available materials and components and conventional fabricating methods can be utilized in its manufacture. The apparatus is durable in construction and has a long useful life with little maintenance.

The asphalt handling apparatus of the invention is self-contained on a single vehicle. Only one or at most two persons are needed to use the apparatus efficiently after a minimum of instruction. The apparatus can be used year round even under adverse weather conditions without sacrificing the quality of the patching. Patching can be done easily and quickly so the cost per patch is significantly less than with previous systems and methods.

It will be apparent that various modifications can be made in the particular asphalt handling apparatus of the present invention as described in detail above and shown in the drawings within the scope of the invention. The size, configuration and arrangement of components can be different to meet specific requirements. These and other changes can be made in the asphalt handling apparatus provided the functioning and operation thereof are not adversely affected. Therefore, the scope of the present invention is to be limited only by the following claims.

What is claimed is:

1. Asphalt handling apparatus including a carriage portion, a hopper portion, a hopper heating portion, as asphalt dispensing portion, a liquid tack material dispensing portion and as equipment lifting portion; said carriage portion including a frame section, an axle member extending transversely of said frame section, a wheel rotatably carried at each end of said axle member; said hopper portion including an elongated trough section with a generally V-shaped cross section, said trough section including transverse end sections with peaked upper edges, said trough section including a generally rectangular open top section, a pair of bi-fold doors selectively covering said open top section, one edge of each of said bi-fold doors being pivotally connected to a longitudinal edge of said trough section adjacent said open top section, said bi-fold doors in a flat configuration contacting one another along a horizontal longitudinal centerline of said trough section located a significant distance above said longitudinal edges of said trough section, free corners of contacting edges of said bi-fold door moving from an open to a closed position closely adjacent to upper edges of transverse end sections of said trough section; said hopper heating portion including an enclosed first chamber disposed immediately below said V-shaped trough section and in direct contact therewith, said first chamber including sloping wing sections having relatively thin substantially uniform cross sections and a deeper central section along the lowest point of said trough section communicating therewith, a heat transfer medium disposed within said first chamber, a U-shaped burner channel disposed substantially horizontally within said central section of said first chamber along the length thereof; a gas burner disposed along the length of a first arm of said U-shaped burner channel, an exhaust stack extending upwardly from a free end of a second arm of said channel, a gas reservoir supplying said burner, an elongated electrical heating element disposed within said central section between said arms of said U-shaped burner channel, controls operating said burner and said heating element; said asphalt dispensing portion including a screw conveyor disposed within said trough section along the lowest point thereof, drive means for said conveyor; said liquid tack material dispensing portion including an elongated second chamber located outside said hopper portion alongside said central section of said hopper heating portion and under one sloping wing section thereof, said second chamber including tubing therein communicating with said central section of said hopper heating portion, valve means communicating with an outlet of said second chamber, delivery means including a nozzle and a length of flexible hose connected to said valve means, a cleaning fluid reservoir communicating with said valve means; said equipment lifting portion including a frame assembly disposed in a generally vertical plane and affixed adjacent a rear transverse trough section on the side of the discharge of said conveyor remote from said liquid tack material dispensing portion, said frame assembly including a fixed section and a vertically movable section slidably engageable therewith, said movable section including an equipment engaging member, a vertically oriented fluid piston/cylinder combination having one end secured to an end of said fixed section and extending therealong, an opposite end of said piston/cylinder combination being secured to said movable section of said frame assembly; whereby asphalt is supplied to said trough section through said open bi-fold doors, heated therein with said heat transfer medium, the resulting hot asphalt discharged from said trough section by said screw conveyor into a cavity in a road that has been coated with liquid tack material, and the asphalt compacted by equipment carried by said lifting portion.

2. Asphalt handling apparatus according to claim 1 wherein said carriage portion includes a truck.

3. Asphalt handling apparatus according to claim 1 wherein said carriage portion includes a trailer.

4. Asphalt handling apparatus according to claim 1 wherein said bi-fold doors are insulated.

5. Asphalt handling apparatus according to claim 1 wherein said bi-fold doors are actuated by piston/cylinder combinations located within said trough section.

6. Asphalt handling apparatus according to claim 1 wherein said burner controls include programming means operating second valve means to provide a lower gas flow to said burner initially and after a time interval a higher operating gas flow.

7. Asphalt handling apparatus according to claim 1 wherein said electrical heating element is oriented substantially parallel to said channel arms.

8. Asphalt handling apparatus according to claim 1 wherein said asphalt dispensing portion includes a pivotable delivery chute.

9. Asphalt handling apparatus according to claim 1 wherein said tack material dispensing portion includes a pump operatively connected with said valve means.

10. Asphalt handling apparatus according to claim 1 wherein said equipment engaging member of said equipment lifting portion includes a platform at the bottom of said movable section with said piston/cylinder combination extending upwardly therefrom.

11. Asphalt handling apparatus according to claim 10 wherein said platform carries a separable vibratory plate.

12. Asphalt handling apparatus according to claim 1 wherein said equipment engaging member of said equipment lifting portion includes a horizontal bar member at the top of said movable section with said piston/cylinder combination extending downwardly therefrom.

13. Asphalt handling apparatus according to claim 12 wherein said horizontal bar member is engageable with a separable portable roller machine.

14. Asphalt handling apparatus according to claim 1 including a hydraulic fluid power system.

15. Asphalt handling apparatus according to claim 1 including a control panel located at the rear of said hopper portion.

16. Asphalt handling apparatus according to claim 1 including a sanding unit selectively attachable to an outlet of said trough section.

17. Asphalt handling apparatus according to claim 16 wherein said sanding unit includes a driven rotatable fan distribution member located adjacent an open bottom of a housing enclosing same.

18. Asphalt handling apparatus according to claim 1 including a hand propane torch disposed adjacent said rear transverse end section of said trough section.

19. Asphalt handling apparatus according to claim 1 including a storage bin disposed adjacent said front transverse end section of said trough section.

* * * * *